US006915916B2

(12) United States Patent
Martins

(10) Patent No.: US 6,915,916 B2
(45) Date of Patent: Jul. 12, 2005

(54) APPARATUS AND METHOD OF CONSTRUCTING DISPLAY

(75) Inventor: Rick Martins, Succa Sunna, NJ (US)

(73) Assignee: Riccarr Displays Inc., Rockaway, NJ (US)

( * ) Notice: Subject to any disclaimer, the term of this patent is extended or adjusted under 35 U.S.C. 154(b) by 71 days.

(21) Appl. No.: 10/417,555

(22) Filed: Apr. 17, 2003

(65) Prior Publication Data

US 2004/0035814 A1 Feb. 26, 2004

(51) Int. Cl.[7] ..... A47B 5/00
(52) U.S. Cl. ..... 211/187; 211/189; 211/186
(58) Field of Search ..... 211/186, 187, 211/192, 191, 189, 134; 248/220.21, 223.41, 223.51, 222.41, 225.21

(56) References Cited

U.S. PATENT DOCUMENTS 1,835,042 A * 12/1931 Hammer ..... 312/227
2,733,037 A * 1/1956 Dunham ..... 248/239
4,258,464 A * 3/1981 Ullman, Jr. ..... 29/525.01
4,858,773 A * 8/1989 Zimmerman ..... 211/149
5,350,073 A * 9/1994 Thornley et al. ..... 211/187
5,607,070 A * 3/1997 Hellyer ..... 211/189
5,738,020 A * 4/1998 Correia ..... 109/51
5,938,367 A * 8/1999 Olson ..... 403/254
6,266,250 B1 * 7/2001 Foye ..... 361/760
2004/0045921 A1 * 3/2004 Muller ..... 211/187
2004/0084394 A1 * 5/2004 Powell ..... 211/192

FOREIGN PATENT DOCUMENTS

WO WO 93/19642 * 3/1993 ..... A47B/57/50

* cited by examiner

*Primary Examiner*—Jennifer E. Novosad
(74) *Attorney, Agent, or Firm*—Walter J. Tencza, Jr.

(57) ABSTRACT

First and second uprights for a display or organizing unit are disclosed. Each upright may have one or more keyholes. Each keyhole may be comprised of first and second openings having a larger and a smaller dimension or diameter, respectively. Each upright may include two vertical members. The first and second uprights may be connected together by a member or members. Each of the member or members may have one or more protrusions or studs for insertion into the keyholes.

22 Claims, 8 Drawing Sheets

APPARATUS AND METHOD OF CONSTRUCTING DISPLAY

FIELD OF THE INVENTION

This invention relates to improved methods and apparatus concerning assembly of shelving, organizers and display units.

BACKGROUND OF THE INVENTION

Shelving, organizers, and display units are adapted to be assembled in the prior art using various techniques. These techniques are inadequate.

SUMMARY OF THE INVENTION

The present invention in one or more embodiments provides a display unit comprised of two uprights which include keyholes. Various components of the display include studs or protrusions which can be easily inserted and locked into the keyholes to connect the various components to the two uprights.

In one embodiment an apparatus is provided comprising first and second uprights. Each upright may have one or more keyholes. Each keyhole may be comprised of first and second openings wherein the first opening has a larger dimension or diameter than the second opening. Each upright may include two vertical members. The first and second uprights may be connected together by a member or members. Each of the member or members may have one or more protrusions or studs each of which has a first portion and a second portion. The first portion of each member may have a dimension which is greater than the second portion of each member. The first portion of each member can be inserted into the larger opening of the keyhole. The second portion can thereafter be inserted into the smaller opening of the keyhole to lock an end of each member into the keyhole. In this manner, members may be used to connect the first and second uprights or first and second vertical members of a particular upright.

The present invention in one or more embodiments also includes a method comprising the steps of inserting first and second portions of a first protrusion of a first member into a first opening of a first keyhole of a first upright, and thereafter inserting the second portion into a second opening of the first keyhole. The first portion typically has a greater dimension than the second portion. The first opening typically has a greater dimension than the second opening. The first portion of the first protrusion cannot pass through the second opening of the first keyhole.

The method may include inserting third and fourth portions of a second protrusion of the first member into a third opening of a second keyhole of a second upright, and thereafter inserting the fourth portion into a fourth opening of the second keyhole. The third portion typically has a greater dimension than the fourth portion. The third opening typically has a greater dimension than the fourth opening. The third portion of the second protrusion cannot pass through the fourth opening of the second keyhole.

The display unit may be comprised of metal and may have full sides that wrap around two corners of shelves.

DETAILED DESCRIPTION OF THE DRAWINGS

Figure 1:
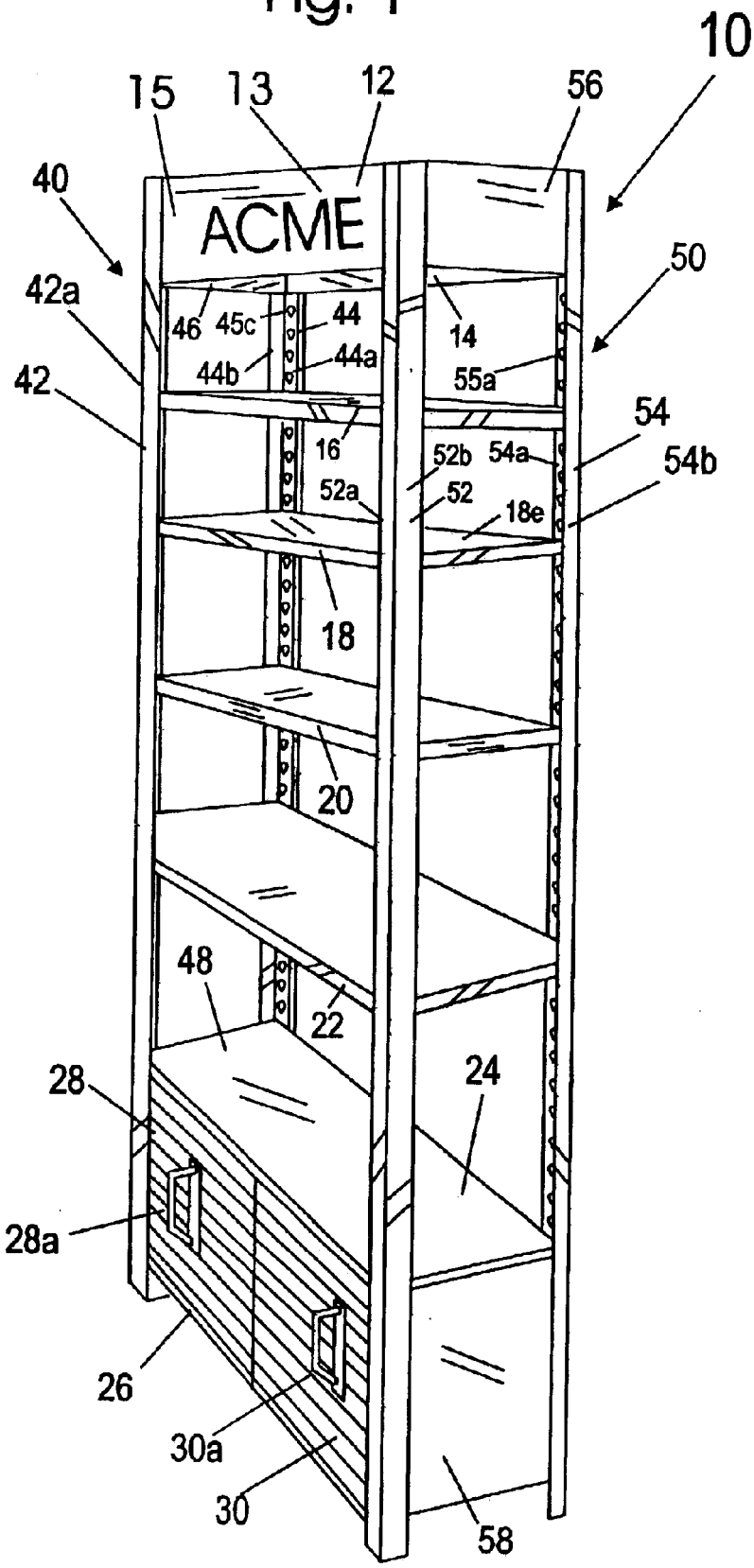
FIG. 1 shows a perspective view of an apparatus in accordance with an embodiment of the present invention.

FIG. 1 shows a perspective view of an apparatus 10 in accordance with an embodiment of the present invention. The apparatus 10 includes a bracket or member 12, a bracket or member 14, shelves 16, 18, 20, 22, and 24, door frames 26 and 126, doors 28, 30, 128, and 130, and left and right uprights 40 and 50. The bracket or member 12 may include a display designation, product name, company name or other designation 13 which may be printed on the front surface 15, such as the example of "ACME" for "ACME" products incorporated.

Figure 2:
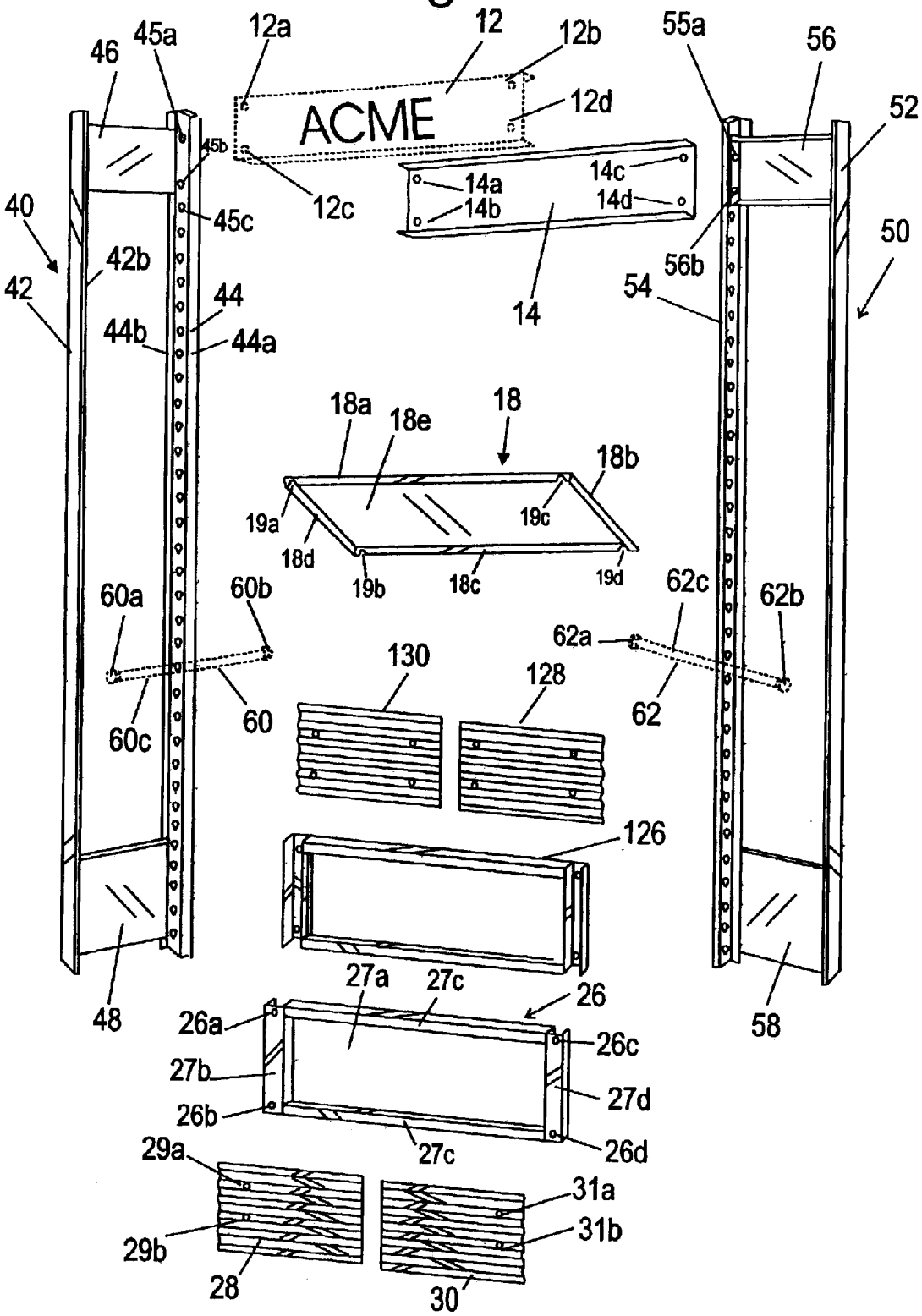
FIG. 2 shows a perspective view of some of the components of the apparatus of FIG. 1.

FIG. 2 shows a perspective view of some of the components of the apparatus 10 of FIG. 1.

Figure 4A:
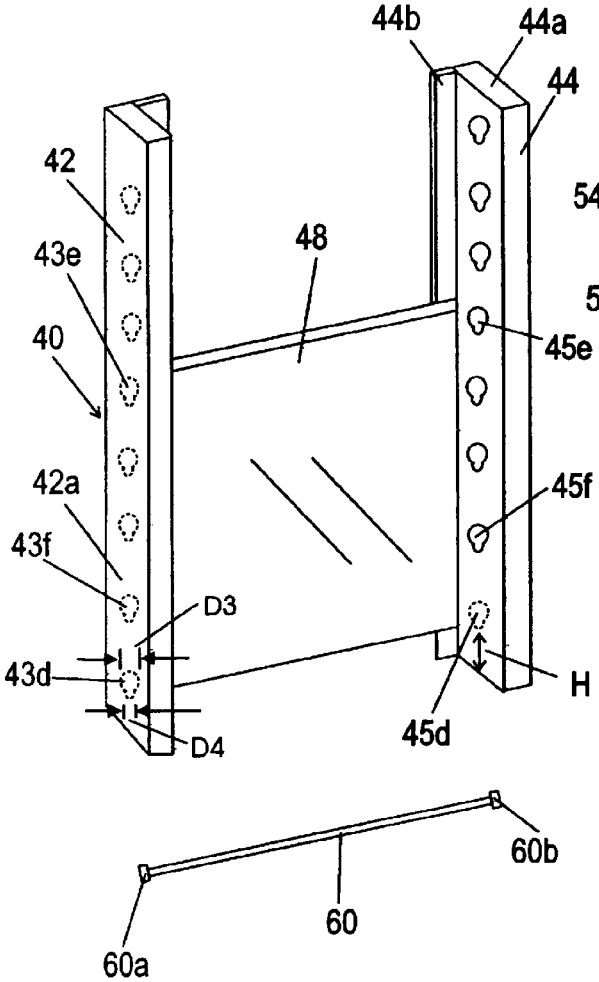
FIGS. 4A and 4B show perspective views of part of the apparatus of FIG. 1 wherein a pair of support members are shown disconnected from left and right uprights, respectively.
Figure 4B:
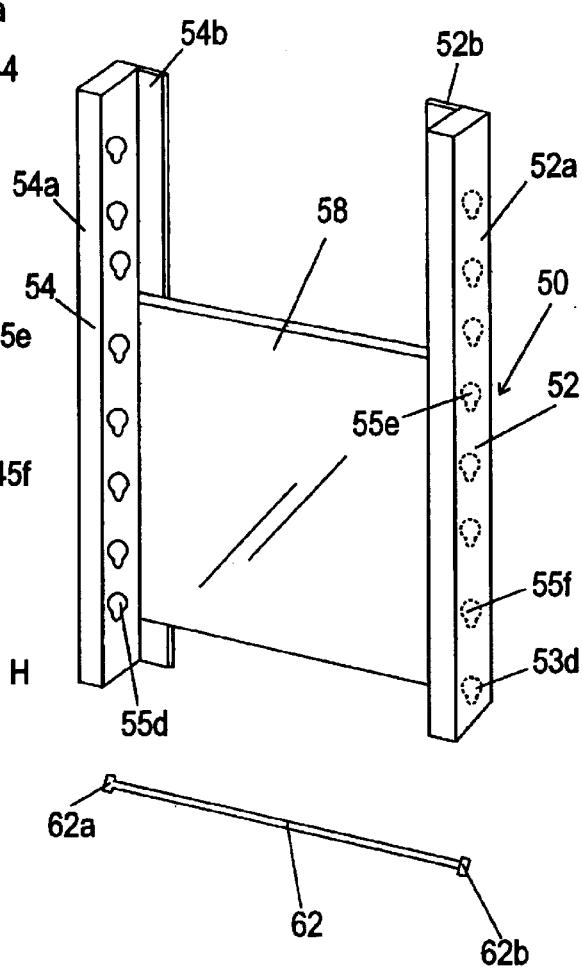
Figure 5A:
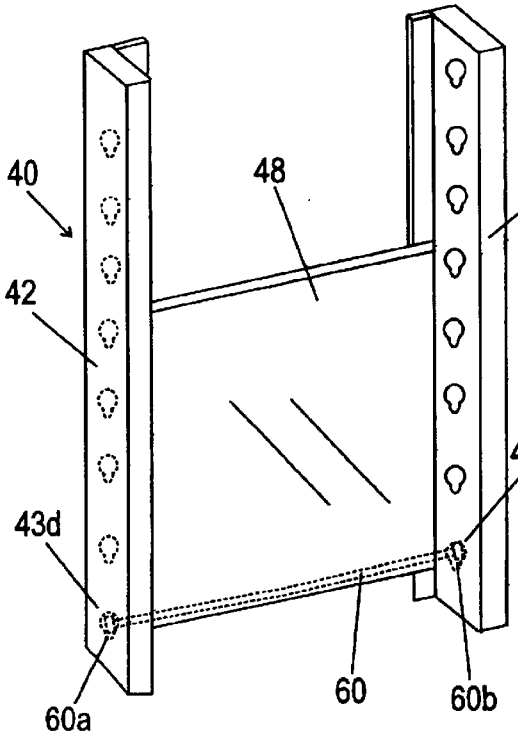
FIGS. 5A and 5B show perspective views of the same parts of the apparatus previously shown in FIGS. 4A and 4B, respectively, wherein the pair of support members have been inserted into large diameter portions of keyholes in the left and right uprights, respectively.
Figure 6A:
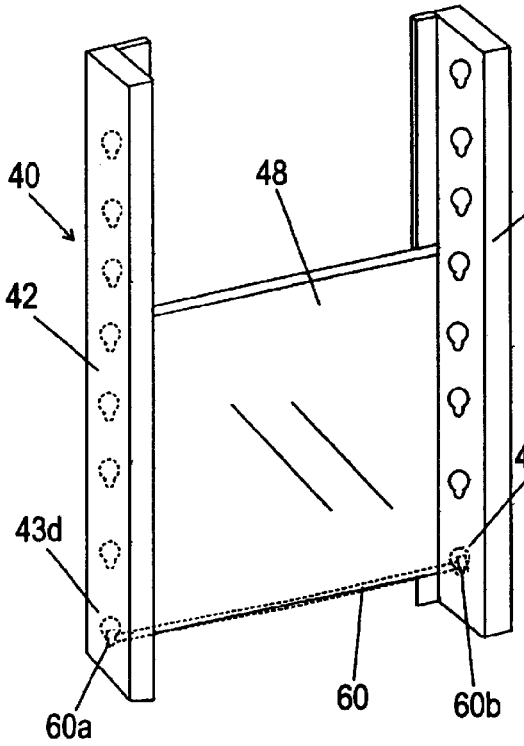
FIGS. 6A and 6B show a perspective view of the same parts of the apparatus previously shown in FIGS. 4A–B and 5A–5B wherein the pair of support members have been pushed down into smaller diameter portions in keyholes in the left and right uprights.

FIGS. 4A and 4B show a portion of left and right uprights 40 and 50, respectively. The left upright 40 includes L shaped members 42 and 44. L-shaped member 42 is further comprised of members 42*a* and 42*b* and L-shaped member 44 is further comprised of members 44*a* and 44*b*. Member 42*a* has a plurality of keyholes, whose locations are shown by dashed lines in FIG. 4A, such as keyhole 43*d*. Each keyhole, such as keyhole 43*d* is comprised of two diameters or dimensions: a large diameter or dimension D3 at the top of the keyhole 43*d* and a small diameter or dimension D4 near the bottom of the keyhole 43*d*. All of the other keyholes may have the same dimensions as keyhole 43*d*. The keyholes, such as 43*d* are designed so that a support member or rod, such as support member or rod 60 in FIG. 4A can be inserted into the large diameter of the keyhole, such as 43*d*, as shown in FIG. 5A, and then pushed downwards into the smaller diameter of the keyhole, as shown in FIG. 6A, to lock the support member or rod 60 in place. I.e. an end 60*a* of the rod 60 has a diameter larger than the small diameter D3 of the keyhole 43*d*, so that end 60*a* once inside member 42*a* and pushed downwards cannot come out of member 42*a* unless the end 60*a* is lifted up and pulled out through large diameter D3 of the keyhole 43*d*. Similarly the rod 60 has an end 60*b*, shown in FIG. 4A, which can be inserted into the large diameter opening of the keyhole 45*d* as shown by FIG. 5A, then pushed down, as shown in FIG. 6A to lock the end 60*b* to the member 44 via keyhole 60*b*.

Figure 5B:
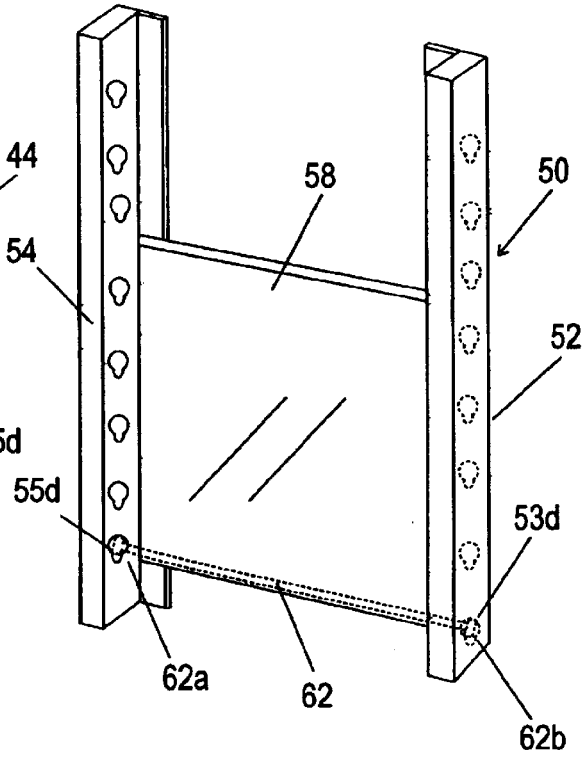
Figure 6B:
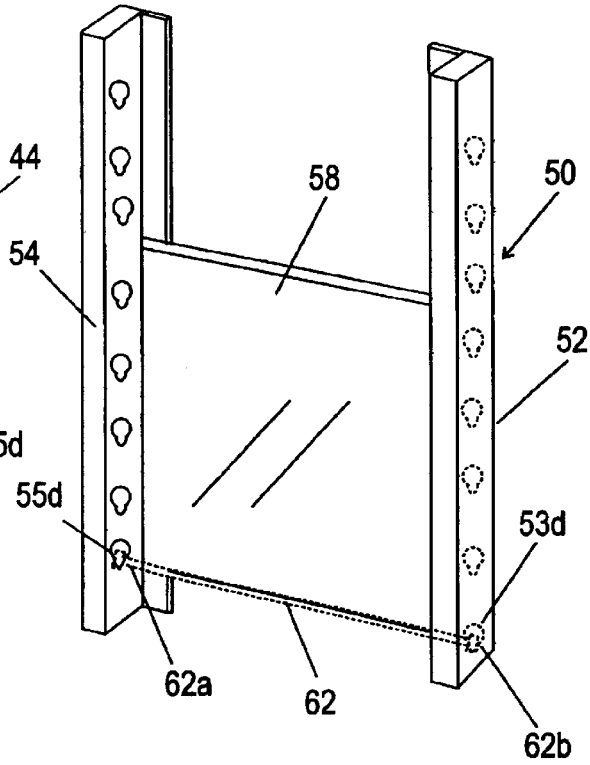

Similarly the keyholes, such as 55*d* on the member 54*a* are designed so that one end of a support member or rod, such as end 62*a* of the support member or rod 62 in FIG. 4B can be inserted into the large diameter portion of the keyhole, such as 55*d*, as shown in FIG. 5B and then pushed downwards into the smaller diameter portion of the keyhole, as shown in FIG. 6B, to lock end 62*a* of the support member or rod 62 in place. I.e. the end 62*a* of the rod 62 has a diameter larger than the small diameter D4 of the keyhole 55*d*, so that end 62*a* once inside the member 54*a* and pushed downwards cannot come out of member 54*a* unless the end 62*a* is lifted up and pulled out through large diameter D3 of the keyhole 55*d*. Similarly the rod 62 has an end 62*b*, shown in FIG. 4B, which can be inserted into the large diameter opening of the keyhole 53*d* as shown by FIG. 5B, then pushed down, as shown in FIG. 6B to lock the end 60*b* to the member 44 via keyhole 60*b*.

Member 44*a* of the L-shaped member 44 of left upright 40, also has a plurality of keyholes which typically have the same dimensions as keyhole 43*d*. Each keyhole on member 42*a* has a corresponding keyhole on the member 44*a*. For example, keyhole 43*d* on the member 42*a* has a corresponding keyhole 45*d* on the member 44*a*. The keyholes 43*d* and 45*d* are also at the same height H or distance from the bottom ends of their members 42*a* and 44*a*, respectively. In this manner a support member or rod such as rod 60 when inserted into keyholes 43*d* and 45*d* will be perpendicular to both the members 42*a* and 44*a*. Similarly, each of the keyholes along the member 42*a* has a corresponding keyhole along the member 44*a* so that the rod 60 can be inserted at a plurality of locations and in a manner so that rod 60 is perpendicular to both members 42*a* and 44*a*.

The right upright 50 is a mirror image of the left upright 40. The right upright 50 includes L-shaped members 52 and 54. The L-shaped member 52 includes members 52*a* and 52*b* and the L-shaped member 54 includes members 54*a* and 54*b*. Member 52*a* has a plurality of keyholes similar to member 42*a* and member 54*a* has a plurality of keyholes similar to member 44*a*. Member 44*b* is perpendicular to member 44*a*. Member 44*b* applies an alternate force to the apparatus 10 allowing for a marked increase to the apparatus 10 strength. The member 44*b* minimizes the sway of apparatus 10.

The left upright 40 includes a plate 46 and a plate 48 which connects the members 42 and 44. The right upright 50 includes plates 56 and 58 which connect the members 52 and 54.

The door frames 26 and 126 may be the same. The door frame 26 may be comprised of opening 27*a*, side 27*b*, bottom 27*c*, side 27*d*, and top 27*e*. The door frame 26 may include protrusions or studs 26*a*, 26*b*, 26*c*, and 26*d*. The door frame 26 can be attached to the members 42*a* and 52*a* of the left and right uprights 40 and 50, respectively. Protrusions 26*a* and 26*b* can be inserted into for example, keyholes 43*e* and 43*f*, respectively, shown in FIG. 4A. Protrusions 26*c* and 26*d* can be inserted into the keyholes 55*e* and 55*f* for member 52. Each of the protrusions 26*a*–26*d* may include a first outer knob portion which is small enough to fit in the large diameter portion of a keyhole, such as 43*e*, but too large to fit through the small diameter portion of a keyhole, such as 43*e*. Each of the protrusions 26*a*–26*d*, may include an inner portion which is small enough to fit through the small diameter portion of a keyhole, such as 43*e*. In operation, the outer knob portion is inserted through the large diameter portion of a keyhole and then the door frame, such as door frame 26, is pushed downwards towards the bottom of the uprights 40 and 50 to lock the door frame 26 in place.

The doors 28 and 30 may be attached to the door frame 26. The doors 128 and 130 may be attached in a similar manner to the door frame 126. The door frame 126 may be attached to the members 44*a* and 54*a* in the same manner that the door frame 26 is connected to the members 42*a* and 52*a*.

Figure 7:
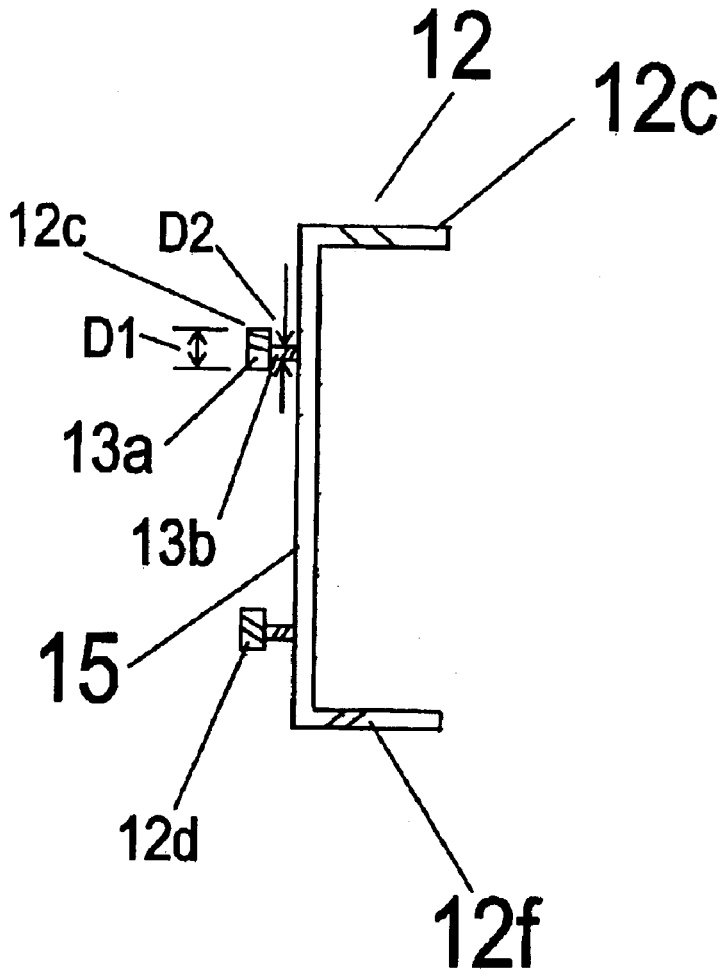
FIG. 7 shows a side view of a bracket which may include a name of a company or product printed on a front plate for display.

The member 12 includes protrusions or studs 12*a*, 12*b*, 12*c*, and 12*d*. The member 14 may be the same as the member 12 and may include protrusions or studs 14*a*, 14*b*, 14*c*, and 14*d*. FIG. 7 shows a side view of the member or bracket 12. The member or bracket 12 may include a name of a company or product printed on a front plate 15. The member or bracket 12 may include a top portion 12*e* and a bottom portion 12*f*. The protrusions or studs 12*a*–12*d* may be similar or the same as protrusions or studs 26*a*–*d* on the door frame 26. The protrusions or studs 12*a*–12*d*, each may have an outer knob portion having a diameter of D1 and an inner portion having a diameter of D2. The outer knob portions of the protrusions 12*a* and 12*c*, fit into the large diameter portions of key holes on the member 42*a* while the outer knob portions of the protrusions 12*b* and 12*d* fit into the large diameter portion of keyhole on the member 52*a*. The member 12 can then be pushed downwards to lock the member 12 in place. The inner portion of the protrusions 12*a*–12*d* will then be in the small diameter portion of the keyholes and the outer knob portions of the protrusions 12*a*–12*d* will be located inside the appropriate member of the members 42*a* and 52*a*. The member 14 may be similar to the member 12 and may be attached in a similar manner to the members 44*a* and 54*a*.

The shelves 16, 18, 20, 22, and 24 may each be identical to the other, and therefore only one shelf 18 will be described. The shelf 18 includes sides 18*a*, 18*b*, 18*c*, and 18*d* and portion 18*e*. Portion 18*e* may be a flat plate. The shelf 18 also includes slots 19*a*, 19*b*, 19*c*, and 19*d*. After a rod, such as member 60 is inserted into keyholes of member 42*a* and member 44*a*, the shelf 18 can be placed over the member 60 in a manner so that the flat portion 18*e* is on top of the member 60 and the member 60 lies within the slots 19*a* and 19*b*. In addition, after the rod 62 is inserted into keyholes of member 52*a* and 54*a*, the shelf 18 can be placed over the member 62 in a manner so that the flat portion 18*e* is on top of the member 60 and the member 60 lies within the slots 19*c* and 19*d*. The shelf is situated so that the shelf flat portion 18*e* is perpendicular to the uprights 40 and 50 and so that the member 60 is in slots 19*a* and 19*b* while the member 62 is simultaneously in slots 19*c* and 19*d*.

Figure 3A:
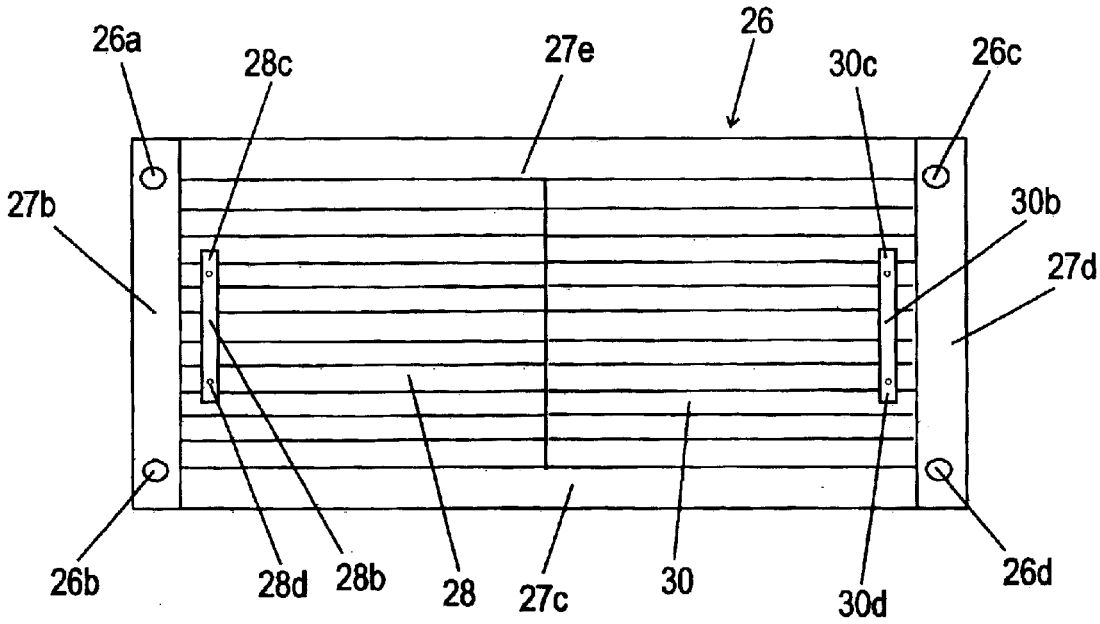
FIG. 3A shows a front view of a door frame and pair of doors for use in the apparatus of FIG. 1.
Figure 3B:
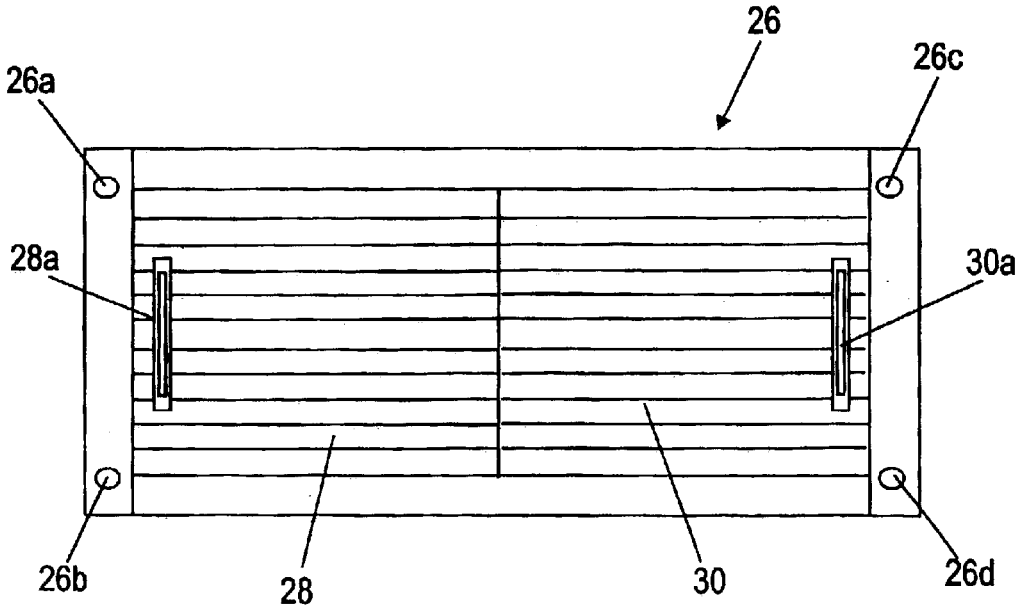
FIG. 3B shows a front view of the door frame and pair of doors of FIG. 3B with the additional of a pair of door handles.

FIG. 3A shows a front view of the door frame 26 and the doors 28 and 30 for use in the apparatus 10 of FIG. 1. FIG. 3A shows raised sections 28*b* and 30*b* where door handles will be located. FIG. 3A also shows holes 28*c* and 28*d* through which screws can be inserted to connect door handle 28*a* to the door frame 26 and holes 30*c* and 30*d* through which screws can be inserted to connect door handle 30*a* to the door frame 26. FIG. 3B shows a front view of the door frame 26 and the pair of doors 28 and 30 of FIG. 3B with the addition of door handles 28*a* and 30*a*.

Figure 8:
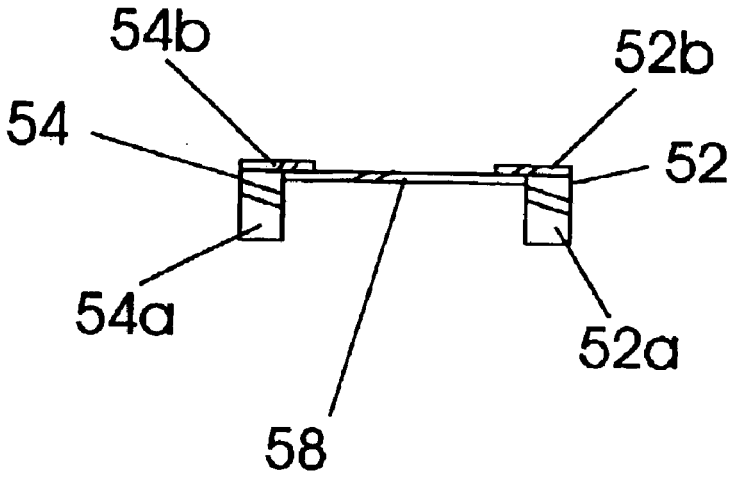
FIG. 8 shows a top view of a right upright used for the apparatus shown in FIG. 1.

FIG. 8 shows a top view of a right upright 50 used for the apparatus 10 shown in FIG. 1. FIG. 8 shows members 54*a* and 54*b* and members 52*a* and 52*b* as well as plate 58.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a left elongated member having a first end, a second end, and a central portion connecting the first end to the second end;

a right elongated member having a first end, a second end, and a central portion connecting the first end to the second end;

a first left upright member and a second left upright member; and a first right upright member and a second right upright member;

wherein each of the first left, second left, first right, and second right upright members has a keyhole comprised of a first opening and a contiguous second opening, the second opening smaller than the first opening;

wherein the first end of the left elongated member is configured to be inserted through the first opening of the keyhole of the first left upright member while the second end of the left elongated member is inserted through the first opening of the keyhole of the second left upright member;

wherein the first end of the left elongated member is configured to not be inserted through the second opening of the keyhole of the first left upright member, and the second end of the left elongated member is configured to not be inserted through the second opening of the keyhole of the second left upright member;

wherein the first end of the right elongated member is configured to be inserted through the first opening of the keyhole of the first right upright member while the second end of the right elongated member is inserted through the first opening of the keyhole of the second right upright member; and wherein the first end of the right elongated member is configured to not be inserted through the second opening of the keyhole of the first right upright member, and the second end of the right elongated member is configured to not be inserted through the second opening of the keyhole of the second right upright member; and further comprising a shelf;

wherein a left part of the shelf near a left end of the shelf is configured to be placed on top of the central portion of the left elongated member while the first and second ends of the left elongated member are inside the keyholes of the first and second left upright members respectively so that the left part of the shelf lies between the first left upright member end the second left upright member; and wherein, simultaneously, a right part of the shelf near a right end of the shelf is configured to be placed on top of the central portion of the right elongated member, while the first and second ends of the right elongated member are inside the keyholes of the first and second right upright members respectively, so that the right part of the shelf lies between the first right upright member and the second right upright member; and wherein the left part of the shelf includes first and second left slots;

wherein when the left part of the shelf is placed on top of the central portion of the left elongated member at least first and second parts of the central portion of the left elongated member lie within the first and second left slots, respectively; and wherein the right part of the shelf includes first and second right slots; and wherein when the right part of the shelf is placed on top of the central portion of the right elongated member, at least first and second parts of the central portion of the right elongated member lie within the first and second right slots respectively.

2. The apparatus of claim 1 wherein when both the first end of the left elongated member is inside the keyhole of the first left upright member and the second end of the left elongated member is inside the keyhole of the second left upright member, the left elongated member is configured to be placed so that at least first and second parts of the central portion of the left elongated member lie within the second openings of the keyholes of the first and second left upright members, respectively; and when both the first end of the right elongated member is inside the keyhole of the first right upright member and the second end of the right elongated member is inside the keyhole of the second right upright member, the right elongated member is configured to be placed so that at least first and second parts of the central portion of the right elongated member lie within the second openings of the keyholes of the first and second right upright members, respectively.

3. The apparatus of claim 1 wherein the left elongated member is configured to be connected substantially perpendicularly at its first end to the first left upright member and substantially perpendicularly at its second end to the second left upright member; and the right elongated member is configured to be connected substantially perpendicularly at its first end to the first right upright member and substantially perpendicularly at its second end to the second right upright member.

4. The apparatus of claim 1 wherein placing the left and right parts of the shelf on top of the left and right elongated members, respectively, connects the left elongated member to the right elongated member.

5. The apparatus of claim 4 wherein the left elongated member is configured to be connected substantially perpendicularly at its first end to the first left upright member and substantially perpendicularly at its second end to the second left upright member; and and the right elongated member is configured to be connected substantially perpendicularly at its first end to the first right upright member and substantially perpendicularly at its second end to the second right upright member.

6. The apparatus of claim 1 wherein the left elongated member is an integrated one piece member; and and the right elongated member is an integrated one piece member.

7. The apparatus of claim 6 wherein the left elongated member is a rod; and the right elongated member is a rod.

8. The apparatus of claim 1 wherein the central portion of the left elongated member has a length;

the central portion of the right elongated member has a length;

and wherein the left elongated member can connect the first left upright member to the second left upright member separated by a distance of about the length of the central portion of the left elongated member, with the left elongated member perpendicular to both the first left upright member and the second left upright member;

and wherein simultaneously the right elongated member can connect the first right upright member and the second right upright member separated by a distance of about the length of the central portion of the right elongated member, with the right elongated member perpendicular to both the first right upright member and the second right upright member.

9. The apparatus of claim 1 wherein the keyholes of the first left, the second left, first right, and second right upright members are located at about the same vertical height.

10. The apparatus of claim 1 wherein the left elongated member has a length;

wherein the first end, the second end, and the central portion of the left elongated member each have a width measured perpendicular to the length of the left elongated member;

wherein the widths of the first and second ends of the left elongated member are substantially the same;

and wherein the width of the central portion of the left elongated member is less than either the width of the first end or the second end of the left elongated member;

and wherein the right elongated member is substantially identical to the left elongated member.

11. An apparatus comprising:

a left elongated member having a first end a second end, and a central portion connecting the first end to the second end;

a right elongated member having a first end, a second end, and a central portion connecting the first end to the second end;

a first left upright member and a second left upright member; and a first right upright member and a second right upright member;

wherein each of the first left, second left, first right, and second right upright members have a keyhole comprised of a first opening and a contiguous second opening, the second opening smaller than the first opening;

wherein the first end of the left elongated members is configured to be inserted through the first opening of the keyhole of the first left upright member while the second end of the left elongated member is inserted through the first opening of the keyhole of the second left upright member;

wherein the first end of the left elongated member is configured to not be in inserted through the second opening of the keyhole of the first left upright member, and the second end of the left elongated member is configured to not be inserted through the second opening of the keyhole of the second left upright member;

wherein the first end of the right elongated member is configured to be inserted through the first opening of the keyhole of the first right upright member while the second end of the right elongated member is inserted through the first opening of the keyhole of the second right upright member; and wherein the first end of the right elongated member is configured to not be inserted through the second opening of the keyhole of the first right upright member, and the second end of the right elongated member is configured to not be inserted through the second opening of the keyhole of the second right upright member; and wherein the left elongated member has a length;

wherein the first and second ends of the left elongated member are configured to be inserted into the first openings of the keyholes of the first and second left upright members, respectively, substantially in a direction parallel to the length of the left elongated member;

wherein the right elongated member has a length; and wherein the first and second ends of the right elongated member are configured to be inserted into the first openings of the keyholes of the first and second right upright members, respectively, substantially in a direction parallel to the length of the right elongated member.

12. A method comprising the steps of inserting a first end of a left elongated member through a first opening of a keyhole of a first left upright member;

inserting a second end of the left elongated member through a first opening of a keyhole of second left upright member;

inserting a first end of a right elongated member through a first opening of a keyhole of a first right upright member; and inserting a second end of the left elongated member through a first opening of a keyhole of a second right upright member;

wherein the first end and the second end of the left elongated member are connected by a central portion;

wherein the first end and the second end of the right elongated member are connected by a central portion;

wherein each of the keyholes of the first left, second left, first right, and second right upright members have a second opening contiguous to the first opening, the second opening smaller than the first opening;

wherein the first end of the left elongated member is configured to not be inserted through the second opening of the keyhole of the first left upright member, and the second end of the left elongated member is configured to not be inserted through the second opening of the keyhole of the second left upright member; and wherein the first end of the right elongated member is configured to not be inserted through the second opening of the keyhole of the first right upright member, and the second end of the right elongated member is configured not to be inserted through the second opening of the keyhole of the second right upright member; and further comprising placing a shelf on top of the first elongated member and the second elongated member; and wherein a left part of the shelf near a left end of the shelf is placed on top of the central portion of the left elongated member while the first and second ends of the left elongated member are inside the keyholes of the first and second left upright members, respectively, so that the left part of the shelf lies between the first left upright member and the second left upright member; and wherein simultaneously a right part of the shelf near a right end of the shelf is configured to be placed on top of the central portion of the right elongated member, while the first and second ends of the right elongated member are inside the keyholes of the first and second right upright members, respectively, so that the right part of the shelf lies between the first right upright member and the second right upright member; and wherein the left part of the shelf includes first and second left slots;

wherein when the left part of the shelf is placed on top of the central portion of the left elongated member, at least first and second parts of the central portion of the left elongated member lie within the first and second left slots, respectively; and wherein the right part of the shelf includes first and second right slots;

wherein when the right part of the shelf is placed on top of the central portion of the right elongated member, at least first and second parts of the central portion of the right elongated member lie within the first and second right slots, respectively.

13. The method of claim 12 wherein when both the first end of the left elongated member is inside the keyhole of the first left upright member and the second end of the left elongated member is inside the keyhole of the second left upright member, the left elongated member is configured to be placed so that at least first and second parts of the central portion of the left elongated member lie within the second openings of the keyholes of the first and second left upright members, respectively; and when both the first end of the right elongated member is inside the keyhole of the first right upright member and the second end of the right elongated member is inside the keyhole of the second right uptight member, the right elongated member is configured to be placed so that at least first and second parts of the central portion of the right elongated member lie within the second openings of the keyholes of the first and second right upright members, respectively.

14. The method of claim 12 wherein the left elongated member is configured to be connected substantially perpendicularly at its first end to the first left upright member and substantially perpendicularly at its second end to the second left upright member; and the right elongated member is configured to he connected substantially perpendicularly at its first end to the first right upright member and substantially perpendicularly at its second end to the second right upright member.

15. The method of claim 12 wherein placing the left and right parts of the shelf on top of the left and right elongated members, respectively, connects the left elongated member to the right elongated member.

16. The method of claim 15 wherein the left elongated member is configured to be connected substantially perpendicularly at its first end to the first left upright member and substantially perpendicularly at its second end to the second left upright member; and and the right elongated member is configured to be connected substantially perpendicularly at its first end to the first right upright member and substantially perpendicularly at its second end to the second right upright member.

17. The method of claim 12 wherein the left elongated member is an integrated one piece member; and and the right elongated member is an integrated one piece member.

18. The method of claim 17 wherein the left elongated member is a rod; and the right elongated member is a rod.

19. The method of claim 12 wherein the central portion of the left elongated member has a length;

the central portion of the right elongated member has a length;

and wherein the left elongated member is configured to connect the first left upright member to the second left upright member separated by a distance of about the length of the central portion of the left elongated member, with the left elongated member perpendicular to both the first left upright member and the second left upright member;

and wherein simultaneously the right elongated member is configured to connect the first right upright member and the second right upright member separated by a distance of about the length of the central portion of the right elongated member, with the right elongated member perpendicular to both the first right upright member and the second right upright member.

20. The method of claim 12 wherein the keyholes of the first left, the second left, first right, and second right upright members are located at about the same vertical height.

21. The method of claim 12 wherein the left elongated member has a length;

wherein the first end, the second end, and the central portion of the left elongated member each have a width measured perpendicular to the length of the left elongated member;

wherein the widths of the first and second ends of the left elongated member are substantially the same;

and wherein the width of the central portion of the left elongated member is less than either the width of the first end or the second end of the left elongated member;

and wherein the right elongated member is substantially identical to the left elongated member.

22. A method comprising the steps of inserting a first end of a left elongated member through a first opening of a keyhole of a first left upright member;

inserting a second end of the left elongated member through a first opening of a keyhole of a second left upright member;

inserting a first end of a right elongated member through a first opening of a keyhole of a first right upright member; and inserting a second and of the left elongated member through a first opening of a keyhole of a second right upright member;

wherein the first end and the second end of the left elongated member are connected by a central portion;

wherein the first end and the second end of the right elongated member are connected by a central portion;

wherein each of the keyhole of the first left, second left, first right and second right upright members have a second opening contiguous to the first opening the second opening smaller than the first opening;

wherein the first end of the left elongated member is configured to not be inserted through the second opening of the keyhole of the first left upright member and the second end of the left elongated member is configured to not be inserted through the second opening of the keyhole of the second left upright member; and wherein the first end of the right elongated member is configured to not be inserted through the second opening of the keyhole of the first right upright member and the second end of the right elongated member is configured to not be inserted through the second opening of the keyhole of the second right upright member; and wherein the left elongated member has a length;

wherein the first and second ends of the left elongated member is configured to be inserted into the first openings of the keyholes of the first and second left upright members, respectively, substantially in a direction parallel to the length of the left elongated member;

wherein the right elongated member has a length; and and wherein the first and second ends of the right elongated member is configured to be inserted into the first openings of the keyholes of the first and second right upright members, respectively, substantially in a direction parallel to the length of the right elongated member.

* * * * *

UNITED STATES PATENT AND TRADEMARK OFFICE

CERTIFICATE OF CORRECTION

PATENT NO. : 6,915,916 B2
DATED : July 12, 2005
INVENTOR(S) : Rick Martins

It is certified that error appears in the above-identified patent and that said Letters Patent is hereby corrected as shown below:

Column 6,
Line 55, “and and” should read -- and --;

Column 7,
Line 43, “have a keyhole” should read -- has a keyhole --;
Line 47, “members” should read -- member --;
Line 54, “to not be in” should read -- to not be --;

Coumn 8,
Line 25, “second left” should read -- a second left --;
Line 30, “left elongated” should read -- right elongated --;

Column 9,
Line 36, “uptight” should read -- upright --;
Line 47, “to he” should read -- to be --;
Lines 60-61, “and and” should read -- and --;

Column 10,
Lines 3-4, “and and” should read -- and --;
Line 35, “each have” should read -- each has --;
Line 62, “each of the keyhole” should read -- each of the keyholes --;
Line 63, “have” should read -- has --.

Signed and Sealed this

Sixth Day of December, 2005

JON W. DUDAS
*Director of the United States Patent and Trademark Office*